US005208636A

United States Patent [19]

Rees et al.

[11] Patent Number: 5,208,636

[45] Date of Patent: May 4, 1993

[54] HIGHLIGHT COLOR PRINTING MACHINE

[75] Inventors: James D. Rees, Pittsford; Cyril G. Edmunds, Webster; Charles H. Tabb, Penfield; Paul A. Garsin, Webster, all of N.Y.

[73] Assignee: Xerox Corporation, Stamford, Conn.

[21] Appl. No.: 856,311

[22] Filed: Mar. 23, 1992

[51] Int. Cl.[5] ..... G03G 15/02

[52] U.S. Cl. ..... 355/219; 118/654; 355/328

[58] Field of Search ..... 355/217, 219, 223, 326, 355/327, 328; 118/647, 651, 653, 654

[56] References Cited

U.S. PATENT DOCUMENTS

| | | | |
|---|---|---|---|
| 4,403,848 | 9/1983 | Snelling | 355/327 |
| 4,562,130 | 12/1985 | Oka | 430/54 |
| 4,660,059 | 4/1987 | O'Brien | 346/157 |
| 4,761,672 | 8/1988 | Parker et al. | 355/220 |
| 4,771,314 | 9/1988 | Parker et al. | 355/328 |
| 4,791,452 | 12/1988 | Kasai et al. | 355/326 |
| 4,833,503 | 5/1989 | Snelling | 355/259 |
| 4,833,504 | 5/1989 | Parker et al. | 355/326 |
| 4,937,636 | 6/1990 | Rees et al. | 355/328 |
| 4,984,021 | 1/1991 | Williams | 355/245 |
| 4,990,955 | 2/1991 | May et al. | 355/208 |
| 4,998,139 | 3/1991 | May et al. | 355/208 |
| 5,003,351 | 3/1991 | Waki et al. | 355/245 |
| 5,010,367 | 4/1991 | Hays | 355/247 |
| 5,021,838 | 6/1991 | Parker et al. | 355/328 |
| 5,031,570 | 7/1991 | Hays et al. | 118/654 |
| 5,045,893 | 9/1991 | Tabb | 355/328 |
| 5,049,949 | 9/1991 | Parker et al. | 355/328 |
| 5,132,730 | 7/1992 | Hurwitch et al. | 355/206 |

*Primary Examiner*—Michael L. Gellner
*Assistant Examiner*—P. J. Stanzione
*Attorney, Agent, or Firm*—H. Fleischer; J. E. Beck; R. Zibelli

[57] ABSTRACT

A printing machine in which two electrostatic latent images are recorded on a photoconductive member. One of the latent images is a charged area latent image with the other image being a discharged area latent image. A magnetic developer unit develops the charged area latent image with black toner particles. A non-magnetic developer unit develops the discharged area latent image with toner particles of a color other than black. The toner particles from both latent images are transferred substantially simultaneously to a sheet and fused thereto forming a color high lighted document.

11 Claims, 1 Drawing Sheet

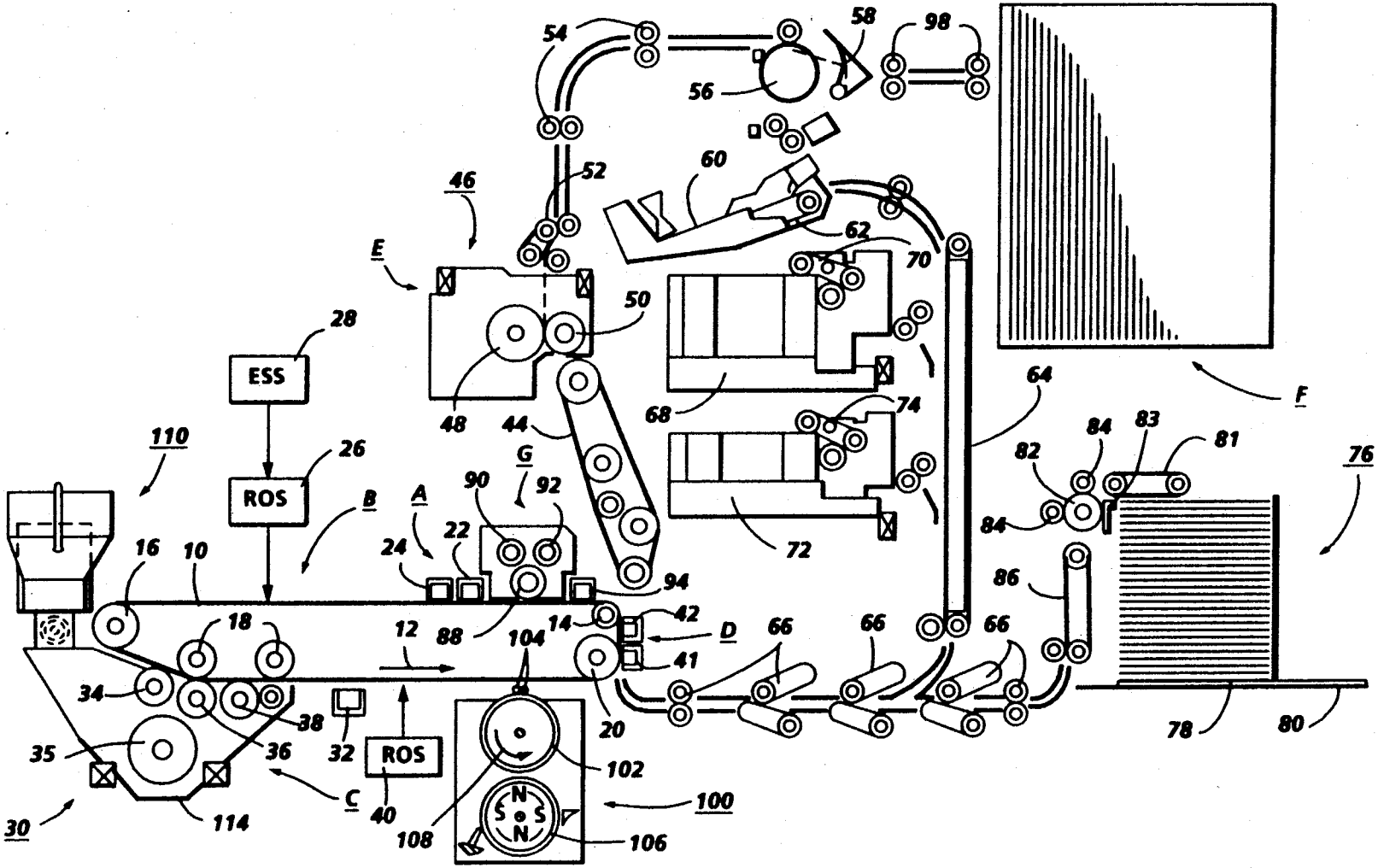
ESS
ROS
ROS

HIGHLIGHT COLOR PRINTING MACHINE

This invention relates generally to an electrophotographic printing machine, and more particularly concerns a printing machine adapted to print a document in at least two different colors.

In the process of electrophotographic printing, a photoconductive surface is charged to a substantially uniform potential. The photoconductive surface is imagewise exposed to record an electrostatic latent image corresponding to the informational areas of an original document being reproduced. Alternatively, a light beam, such as a laser beam may be modulated to expose the charged portion of a photoconductive surface selectively, thereby recording a latent image thereon. In either case, information is recorded as an electrostatic latent image on the photoconductive surface. Thereafter, a developer material is transported into contact with the electrostatic latent image. Typical developer materials include carrier granules having toner particles adhering triboelectrically thereto. The toner particles are attracted from the carrier granules of the developer material onto the latent image. The resultant toner powder image is then transferred from the photoconductive surface to a sheet and permanently affixed thereto. The foregoing generally describes a typical mono-color electrophotographic printing machine.

Recently, electrophotographic printing machines had been developed which produce highlight color copies. A typical highlight color printing machine records successive electrostatic latent images on the photoconductive surface. When combined, these electrostatic latent images form a latent image corresponding to the entire original document being printed. One latent image is usually developed with black toner particles. The other latent image is developed with color highlighting toner particles, e.g. red toner particles. These developed toner powder images are transferred sequentially to a sheet to form a color highlighted document. A color highlighting printing machine of this type is a two-pass machine. Single pass highlight color printing machines using tri-level printing have also been developed. Tri-level electrophotographic printing is described in greater detail in U.S. Pat. No. 4,078,929. As described in this patent, the latent image is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, relatively negative and relatively positively charged toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image and improves color sharpness.

In tri-level electrophotographic printing, the charge on the photoconductive surface is divided in three, rather than two, ways as is the case in mono-color printing. The photoconductive surface is charged and exposed imagewise such that one image corresponds to the charged areas and remains at the full charged potential. The other image, which corresponds to discharged image areas, is exposed to discharge the photoconductive surface to its residual potential. The background areas are exposed to reduce the photoconductive surface potential to about halfway between the charged and discharged potentials. A developer unit arranged to develop the charged images is typically biased to a potential between the background potential and the full potential. The developer unit arranged to develop the discharged imaged areas is typically biased to a level between the background potential and the discharged potential. The single pass nature of this system dictates that the electrostatic latent image passes through the developer unit in a serial fashion. Another type of printing machine which may produce highlight color copies initially charges the photoconductive member. Thereafter, the charged portion of the photoconductive member is discharged to form an electrostatic latent image thereon. The latent image is subsequently developed with black toner particles. The photoconductive member is then recharged and imagewise exposed to record the highlight color portions of the latent image thereon. A highlight latent image is then developed with toner particles of a color other than black, e.g. red then develop the highlight latent image. Thereafter, both toner powder images are transferred to a sheet and subsequently fused thereto to form a highlight color document. Various types printing machines have hereinbefore been used as illustrated by the following disclosures, which may be relevant to certain aspects of the present invention.

U.S. Pat. No. 4,403,848, Patentee: Snelling, Issued: Sep. 13, 1983.

U.S. Pat. No. 4,660,059, Patentee: O'Brien, Issued: Apr. 21, 1987.

U.S. Pat. No. 4,761,672, Patentee: Parker et al., Issued: Aug. 2, 1988.

U.S. Pat. No. 4,771,314, Patentee: Parker et al., Issued: Sep. 13, 1988.

U.S. Pat. No. 4,833,503, Patentee: Snelling, Issued: May 23, 1989.

U.S. Pat. No. 4,833,504, Patentee: Parker et al., Issued: May 23, 1989.

U.S. Pat. No. 4,937,636 Patentee: Rees et al. Issued: Jun. 26, 1990.

U.S. Pat. No. 4,984,021, Patentee: Williams, Issued: Jan. 8, 1991.

U.S. Pat. No. 4,990,955, Patentee: May et al., Issued: Feb. 5, 1991.

U.S. Pat. No. 4,998,139, Patentee: May et al., Issued: Mar. 5, 1991.

U.S. Pat. No. 5,003,351, Patentee: Waki et al., Issued: Mar. 26, 1991.

U.S. Pat. No. 5,010,367, Patentee: Hays, Issued: Apr. 23, 1991.

U.S. Pat. No. 5,021,838, Patentee: Parker et al., Issued: Jun. 4, 1991.

U.S. Pat. No. 5,031,570, Patentee: Hays et al., Issued: Jul. 16, 1991.

U.S. Pat. No. 5,045,893, Patentee: Tabb, Issued: Sep. 3, 1991.

U.S. Pat. No. 5,049,949, Patentee: Parker et al., Issued: Sep. 17, 1991.

The relevant portions of the foregoing patents may be summarized as follows:

U.S. Pat. No. 4,403,848 discloses a multi-color printer wherein the photoconductive member is charged, exposed and developed with toner particles of the first color. Thereafter, the photoconductive member is reexposed, developed with toner particles of a second color and the toner particles of both colors transferred to a sheet. After transferring the toner particles to the sheet, the toner particles are fused thereto.

U.S. Pat. No. 4,660,059 describes an apparatus on which a document is printed in two different colors. Ions are projected onto a dielectric surface to record a first electrostatic latent image thereon. The first electrostatic latent image is developed with toner particles of a first color. Thereafter, the first electrostatic latent image recorded on the dielectric member is substantially neutralized. A second ion projector then projects ions onto a dielectric surface to record another electrostatic latent image. This second electrostatic latent image is then developed with toner particles of a second color. The toner particles of the first color and the second color are transferred from the dielectric member to a sheet and subsequently fused thereto forming a highlight color document.

U.S. Pat. No. 4,761,672 and U.S. Pat. No. 4,771,314 describe a developer apparatus for forming toner images in black and at least one highlighting color in a single pass of the photoreceptor through the use of a tri-level system.

U.S. Pat. No. 4,771,314 also describes a printing machine for forming toner images in black and at least one highlighting color in a single pass by using a tri-level system.

U.S. Pat. No. 4,791,452 and U.S. Pat. No. 4,833,503 describes a system for forming a highlight color copy wherein photoconductive belt is charged, exposed, and developed to form first toner powder image thereon. Thereafter, the photoconductive member is recharged, reexposed and developed with toner particles of another color. The toner particles of both colors are than transferred from the photoconductive surface to a sheet and, subsequently, fused thereto, forming a highlight color document.

U.S. Pat. No. 4,833,504 describes a tri-level system using a magnetic brush development apparatus having a plurality of developer housings with the magnetic rolls disposed in the second developer housing being constructed so that the radial component of the magnetic force field produces a magnetically free development zone intermediate the photoconductive surface and the magnetic rolls.

U.S. Pat. No. 4,937,636 describes a printing machine which forms a two-color output copy in a single pass. A latent image is formed having three separate discharge levels corresponding to the black information, color fluorescent areas and the background areas. The black and color areas are developed with appropriately colored toner by developer units biased to the appropriate levels.

U.S. Pat. No. 4,984,021 describes a tri-level system wherein discharged area development precede charged area development. The edges of the photoreceptor as well as the image area are charged. This prevents the edges from being developed with toner particles and reduces contamination.

U.S. Pat. No. 4,990,955 discloses an apparatus for stabilizing white discharged level of a tri-level image at a predetermined level.

U.S. Pat. No. 4,998,139 describes a tri-level printing system which includes a development controller for stabilizing the white discharged level at a predetermined voltage. The bias voltages for the developer housings for charged area and discharged area development are independently adjustable for maintaining image background levels within acceptable limits.

U.S. Pat. No. 5,003,351 describes an electrophotographic printing machine which employs a plurality of developer units capable of forming multi-color images and full-color images. Different developer bias voltages are applied to the developer roller so as to match the photoconductive surface properties.

U.S. Pat. No. 5,010,367 describes a development system employing electrode wires disposed in the development zone between the donor roller and the photoconductive surface. Toner particles are transported by the donor roller to the development zone. The electrode wires are electrically biased to detach toner particles from the donor roll forming a toner powder cloud in the development zone. Toner particles from the toner powder cloud develop the electrostatic latent image recorded on the photoconductive surface.

U.S. Pat. No. 5,021,838 describes a tri-level printing system wherein the charged area is developed with black toner particles and the discharged area is developed with toner particles of a color other than black. The first developer unit, in the direction of movement of the photoconductive belt, develops the charged area and the second developer unit develops the discharged area.

U.S. Pat. No. 5,031,570 describes a scavengeless development system for use in a tri-level printing machine. A first magnetic brush developer unit develops the charged area with black toner particles and a second magnetic brush developer unit having electrically biased electrode wires in the development zone, develops the discharged areas with toner particles of a color other than black.

U.S. Pat. No. 5,045,893 describes a single pass printer which utilizes two image systems for forming electrostatic latent images on a photoconductive surface. A bi-level image is developed using an insulated magnetic brush, a highly agitated zone, a magnetically agitated zone or other high resolution development system using discharged area development having negative black toner and positive carrier. The imaging device discharges all non-developed charged areas of the bi-level image except those to be developed in color.

U.S. Pat. No. 5,049,949 describes a highlight printing machine for forming one black and two images of a different color. The printing machine uses a tri-level imagining system to create images containing one black and two color images. The photoconductive surface is uniformly charged and exposed to form a tri-level latent image comprising a charged area image, a discharged area image and background area image.

In accordance with one aspect of the present invention, there is provided an electrophotographic printing machine adapted to print indicia on a document. The printing machine includes a moving photoconductive member. Means are provided for recording at least two electrostatic latent images on the photoconductive member. One of the latent images is a charged area and the other latent image is a discharged area. Means develop the charged area latent image with first marking particles and the discharged area latent image with second marking particles. The first marking particles have different properties then the second marking particles. The charged area latent image is developed before the discharged area latent image in the direction of movement of the photoconductive member. Means transfers the first and second marking particles from the photoconductive member to the document. Means substantially permanently fuse the first and second marking particles to the document forming a indicia thereon.

Other aspects of the present invention will become apparent as the following description proceeds and upon reference to the drawing.

The drawing FIGURE is a schematic elevational view depicting an illustrative electrophotographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the FIGURE. The FIGURE schematically depicts an electrophotographic printing machine incorporating the features of the present invention therein. It will become evident from the following discussion that the features of the present invention may be used in a wide variety of printing machines and is not specifically limited in this application to the particular embodiment depicted herein.

Referring now to the Figure, the electrophotographic printing machine employs a photoconductive belt 10. Preferably, the photoconductive belt 10 is made from a photoconductive material coated on a ground layer, which, in turn, is coated on anti-curl backing layer. The photoconductive material is made from a transport layer coated on a generator layer. The transport layer transports positive charges from the generator layer. The interface layer is coated on the ground layer. The transport layer contains small molecules of di-m-tolydiphenydiphenylbithenyldiamine dispersed in a polycarbonte. The generation layer is made from trigonal selenium. The grounding layer is made from a titanium coated mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all the required charge on photoconductive belt 10. Corona generating device 24 acts as leveling device, and fills in any areas missed by corona generating device 22.

Next, the charged portion of the photoconductive surface is advanced through imaging station B. At imaging station B, the uniformly charged photoconductive surface is exposed by an imager, such as a laser based input and/or output scanning device 26, which causes the charged portion of the photoconductive surface to be discharged in accordance with the output from the scanning device. The scanning device is a laser raster output scanner (ROS). The ROS performs the function of creating the output image copy on the photoconductive surface. It lays out the image in a series of horizontal scan lines with each line having a certain number of pixels per inch. The ROS may include a laser with rotating polygon mirror blocks and a suitable modulator or, in lieu thereof, a light emitting diode array (LED) as a write bar. An electronic subsystem (ESS) 28 is the control electronics which prepare and manage the image data flow between the data source and the ROS. It may also include a display, user interface and electronic storage, i.e. memory, functions. The ESS is actually a selfcontained, dedicated mini computer. The photoconductive surface, which is initially charged to a high charge potential, is discharged imagewise in the background areas and remains charged in the image areas in the black parts of the image.

At development station C, a magnetic brush development system, indicated generally by the reference numeral 30 advances developer material into contact with the electrostatic latent image. The development system comprises three magnetic brush developer rollers, indicated generally by the reference numerals 34, 36 and 38. A paddle wheel 35 picks up developer material from developer sump 114 and delivers it to the developer rollers. When developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roller, positioned after developer roll 38, in the direction of arrow 12, is a carrier granular removal device adapted to remove any carrier granules adhering to belt 10. Thus, rolls 34 and 36 advance developer material into contact with the electrostatic latent image. The latent image attracts toner particles from the carrier granules of the developer material to form a developed toner powder image on the photoconductive surface of belt 10. Toner dispenser 110 discharges unused toner particles into sump 114. Developer rolls 34 and 36 are substantially identical. Each of the foregoing developer rollers include a rotating sleeve having a stationary magnetic disposed interiorly thereof. The magnetic field generated by the magnet attracts developer material from paddle wheel 35 to the sleeve of the developer roller. As the sleeve rotates, it advances the developer material into the development zone where toner particles were attracted from the carrier granules to the charged area latent image. In this way, the charged area latent image is developed with these toner or marking particles. The toner particles being employed in developer unit 30 are black. Thus, the charged area latent image is developed by developer unit 30 with black toner particles. The black developed latent image continues to advance with photoconductive belt 10 in the direction of arrow 12.

Corona generator 32 recharges photoconductive surface of belt 10. A second imager, such as ROS 40, which may for example be an LED bar, illuminates the recharged photoconductive surface to selectively discharge the photoconductive surface. The photoconductive surface is discharged in the image areas and charged in the non-image areas to record a discharged latent image thereon. Thereafter, the discharged latent image is developed by a developer unit, indicated generally by the reference numeral 100.

Developer unit 100 includes a donor roll 102, electrode wires 104 and a magnetic roll 106. The donor roll 102 can be rotated in either the (width) or (against) direction relative to the motion of belt 10. The donor roller shown rotating in the direction of arrow 108. Electrode wires 104 are located in the development zone defined as the space between photoconductive belt 10 and donor roll 102. The electrode wires 104 include one or more thin tungsten wires which are lightly positioned against donor roll 102. The distance between wires 104 and donor roll 102 is approximately the thickness of the toner layer on donor roll 102. The extremities of the wires are supported by the tops of end bearing blocks (not shown) which also support donor roll 102 for rotation. An electrical bias is applied to the electrode wires by a voltage source. A AC bias is applied to the electrical wires with the wires being at a DC bias. A voltage source electrically biases the electrode wires with both a DC potential and an AC potential. A DC voltage source establishes an electrostatic field between photoconductive belt 10 and donor roll 102. In operation, magnetic roll 106 advances developer material comprising carrier granules and toner particles into a loading zone adjacent donor roll 102. The electrical bias between donor roll 102 and magnetic roll 106 causes the toner particles to be attracted from the carrier granules to donor roll 102. Donor roll 102 advances the toner particles to the development zone. The electrical bias on electrode wires 104 detaches the toner particles on donor roll 102 and forms a toner powder cloud in the development zone. The discharged latent image attracts the detached toner particles to form a toner powder image thereon. The toner particles in developer unit 100 are of a color other than black, for example, the toner particles may be red or blue. After the charged area latent image is developed with black toner particles and the discharged area latent image developed with toner particles of a color other than black, belt 10 advances the resultant toner powder image to transfer station D. At transfer station D, a sheet or document is moved into contact with the toner powder image. Thus, photoconductive belt 10 is exposed to a pre-transfer light from a lamp (not shown) to reduce the attraction between the photoconductive belt and the toner powder image. Next, a corona generating device 41 charges the sheet to the proper magnitude and polarity as the sheet is passed through photoconductive belt 10. The toner powder image is attracted from photoconductive belt 10 to the sheet. After transfer, a corona generator 42 charges the sheet to the opposite plurality to detack the sheet from belt 10. Conveyor 44 advances the sheet to fusing station E.

One skilled in the art will appreciate that while developer unit 30 has been described as developing the charged area latent image with black toner particles and developer unit 100 with non-black toner particles, both developer units can develop the respective latent images with black toner particles with the toner particles from one of the developer units being magnetic and the toner particles from the other developer unit being non-magnetic. Moreover, one of the developer units may develop one of the latent images with non-black toner particles while the other developer unit develops the latent image with magnetic toner particles. In this way, the printing machine of the present invention may be used to produce a document having both magnetic and non-magnetic indicia thereon as well as documents having highlight color.

Fusing station E includes a fuser assembly indicated generally by the reference numeral 46, which permanently affixes the transferred toner powder image to the sheet. Preferably, fuser assembly 46 includes a heated fuser roll 48 and a pressure roll 50 with the powder image on the sheet contacting fuser roll 48. The pressure roll is cammed against the fuser roll to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the sheets are fed through a decurler 52. Decurler 52 bends the sheet in a first direction and puts a known curl in the sheet, and then bends it in the opposite direction to remove that curl.

Forwarding rollers 54 than advance the sheet to duplex turn roll 56. Duplex selenoid gate 58 guides the sheet to the finishing station F or to duplex tray 60. At finishing station F, sheets are stacked in a complier to form sets of cut sheet. The sheets of each set are optionally stapled to one another. The set of sheets are then delivered to a stacking tray. In a stacking tray, each set of sheets may be offset from an adjacent set of sheets.

With continued reference to the Figure, duplex selenoid gate 58 directs the sheet into duplex tray 60. Duplex tray 60 provides an intermediate or buffer storage for those sheets that have been printed on one side on which an image will be subsequently printed on the second, opposed side thereof, i.e. the sheets being duplexed. The sheets are stacked in duplex tray 60 face down on top of one another in the order in which they are being printed.

In order to complete duplex printing, the simplex sheets in tray 60 are fed, in seriatim, by bottom feeder 62 from tray 60 back to transfer station D via a conveyor 64 and rollers 66 for transfer of the toner powder image to the opposed side of the sheet. Inasmuch as successive sheets are fed from duplex tray 60, the proper or clean side of the sheet is positioned in contact with belt 10 at transfer station D so that the toner powder image is transferred thereto. The duplex sheet is then fed through the same path as the simplex sheet to be advanced to finishing station F.

Sheets are fed to transfer station D from secondary tray 68. Secondary tray 68 includes an elevator driven by a bi-directional AC motor. Its controller has the ability to drive the tray up or down. When the tray is in the down position, stacks of sheets are loaded thereon or unloade therefrom. In the up position, successive sheets may be fed therefrom by sheet feeder 70. Sheet feeder 70 is a friction retard feeder utilizing a feed belt and take-away rolls to advance successive sheets to transport 64 which advances the sheets to rolls 66 and then to transfer station D.

Sheets may also be fed to transfer station D from the auxiliary tray 72. Auxiliary tray 72 includes an elevator driven by bi-directional AC motor. Its controller has the ability to drive the tray up or down. When the tray is in the down position, stacks of sheets are loaded thereon or unloaded therefrom. In the up position, successive sheets may be fed therefrom by sheet feeder 74. Sheet feeder 74 is a friction retard feeder utilizing a feed belt and take-away rolls to advance successive sheets to transport 64 which advances the sheets to rolls 66 and to transfer station D.

Secondary tray 68 and auxiliary tray 72 are secondary sources of sheets. A high capacity feeder indicated generally by the reference numeral 76, is the primary source of sheets. High capacity feeder 76 includes a tray 78 supported on elevator 80. The elevator is driven by a bi-directional AC motor to move the tray up or down. In the up position, the sheets are advanced from the tray to transfer station D. A fluffer and air knife directs air onto the stack of sheets on tray 78 to separate the uppermost sheet from the stack of sheets. A vacuum pulls the uppermost sheet against the belt 81. Feed belt 81 feeds successive uppermost sheets from the stack to a take-away drive roll 82 and idler rolls 84. The drive rolls and modular rolls guide the sheet onto transport 86. Transport 86 advances the sheet to roll 66 which, in turn, move the sheet to transfer station D.

Invariably, after the sheet is separated from photoconductive belt 10, some residual toner particles remain adhering thereto. After transfer, photoconductive belt 10 passes beneath corona generating device 94 which charges the residual toner particles to the proper polarity. Thereafter, the pre-charge array lamp (not shown), located inside photoconductive belt 10 discharges the photoconductive belt in preparation for the next imaging cycle. Residual particles are removed from the photoconductive surface at cleaning station G.

Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper, debris and wrong sign toner particles. The toner particles on the reclaim roll are scrapped off and deposited in a reclaim auger (not shown), where it is transported out of the rear of the cleaning station G.

In recapitulation, the printing machine is adapted to print a document in at least two different colors or a document having magnetic and non-magnetic indicia therein. Two electrostatic latent images are recorded on the photoconductive member. One of the latent images is a charged area latent image and the other latent image is a discharged area latent image. A magnetic developer unit develops the charged area latent image with a first type of toner particles and a non-magnetic developer unit develops the discharged area latent image with a second type of toner particles. The properties of the first and second type of toners are different from one another. The toner particles may be of different colors as well as being magnetic or non-magnetic. After development, the different toner particles are transferred from the photoconductive member to the document. The toner particles on the document are then permanently fused thereto forming indicia on the document.

While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An electrophotographic printing machine adapted to print indicia on a document, including:

a moving photoconductive member;

means for recording at least two electrostatic latent images on said photoconductive member with one of the latent images being a charged area and the other of the latent images being a discharged area with the charged area latent image being positioned on said photoconductive member before the discharged area latent image in the direction of movement of said photoconductive member;

means for developing the charged area latent image with first marking particles and the discharged area latent image with second marking particles having different properties than the first marking particles with the charged area latent image being developed before the discharged area latent image in the direction of movement of said photoconductive member, said developing means includes magnetic means for developing the charged area latent image with the first marking particles, and non-magnetic means for developing the discharged area latent image with the second marking particles, said recording means records the discharged area latent image after said developing means develops the charged area latent image with the first marking particles, said recording means includes means for charging at least a portion of said photoconductive member, means for exposing the charged portion of said photoconductive member to record the charged area latent image thereon, means for recharging said photoconductive member after the charged area latent image is developed; and means for exposing the recharged portion of said photoconductive member to record the discharged area image thereon;

means for transferring the first and second marking particles from said photoconductive member to the document; and means for substantially permanently fusing the first and second marking particles to the document to form the indicia on the document.

2. A printing machine according to claim 1, wherein said non-magnetic means includes:

means for transporting the second marking particles to a development zone adjacent the photoconductive member; and an electrically biased electrode member disposed in the development zone and adapted to detach the second marking particles from said transport means to form a cloud of second marking particles in the development zone to develop the discharged area latent image.

3. A printing machine according to claim 2, wherein said electrode member includes a plurality of wires.

4. A printing machine according to claim 3, wherein said transporting means includes a donor roll.

5. A printing machine according to claim 4, wherein said magnetic means includes:

a rotating non-magnetic sleeve; and a stationary magnet disposed interiorly of said sleeve.

6. A printing machine according to claim 1, wherein the first marking particles are of a different color than the second marking particles.

7. A printing machine according to claim 6, wherein the first marking particles are black in color, and the second marking particles are non-black in color.

8. A printing machine according to claim 1, wherein the first marking particles are magnetic.

9. A printing machine according to claim 8, wherein the second marking particles are non-magnetic.

10. A printing machine according to claim 1, wherein the second marking particles are magnetic.

11. A printing machine according to claim 10, wherein the first marking particles are non-magnetic.

* * * * *